US008864285B2

(12) United States Patent
De Roeck

(10) Patent No.: US 8,864,285 B2
(45) Date of Patent: Oct. 21, 2014

(54) SYSTEM AND METHOD FOR CLEANING A NOZZLEPLATE

(75) Inventor: Luc De Roeck, Kontich (BE)

(73) Assignee: Agfa Graphics NV, Mortsel (BE)

( * ) Notice: Subject to any disclaimer, the term of this patent is extended or adjusted under 35 U.S.C. 154(b) by 0 days.

(21) Appl. No.: 14/127,498

(22) PCT Filed: Jun. 25, 2012

(86) PCT No.: PCT/EP2012/062228

§ 371 (c)(1),
(2), (4) Date: Dec. 19, 2013

(87) PCT Pub. No.: WO2013/000862

PCT Pub. Date: Jan. 3, 2013

(65) Prior Publication Data

US 2014/0132669 A1 May 15, 2014

Related U.S. Application Data

(60) Provisional application No. 61/502,877, filed on Jun. 30, 2011.

(30) Foreign Application Priority Data

Jun. 29, 2011 (EP) ..... 11171932

(51) Int. Cl.
*B41J 2/015* (2006.01)
*B41J 2/165* (2006.01)

(52) U.S. Cl.
CPC ..... *B41J 2/16526* (2013.01); *B41J 2/16552* (2013.01); *B41J 2/16538* (2013.01)
USPC ..... 347/35; 347/21; 347/22; 347/33; 347/36

(58) Field of Classification Search
CPC ..... B41J 2/16523; B41J 2/16526; B41J 2/16538; B41J 2/16535; B41J 2/16552
USPC ..... 347/21–22, 33, 35–36
See application file for complete search history.

(56) References Cited

U.S. PATENT DOCUMENTS

| | | | |
|---|---|---|---|
| 5,557,306 | A | 9/1996 | Fukushima et al. |
| 6,164,754 | A | 12/2000 | Ide et al. |
| 6,193,353 | B1 | 2/2001 | Vives et al. |
| 6,241,337 | B1 | 6/2001 | Sharma et al. |
| 6,869,161 | B2 | 3/2005 | Wouters et al. |
| 2004/0001116 | A1 | 1/2004 | Wouters et al. |

FOREIGN PATENT DOCUMENTS

| | | |
|---|---|---|
| EP | 1 002 649 A2 | 5/2000 |
| EP | 1 018 430 A1 | 7/2000 |
| EP | 1 219 434 A1 | 7/2002 |

OTHER PUBLICATIONS

Official Communication issued in International Patent Application No. PCT/EP2012/062228, mailed on Aug. 16, 2012.

*Primary Examiner* — Jason Uhlenhake
(74) *Attorney, Agent, or Firm* — Keating & Bennett, LLP

(57) ABSTRACT

A system and a method for cleaning a printhead by providing from a first slit a laminar flow of cleaning fluid that flows through a pretensioned brush for brushing the nozzle plate and collecting debris. The cleaning fluid with the debris is drained by a first slit having a first under pressure and next by a second slit that has a second under pressure that is greater than the first under pressure.

12 Claims, 3 Drawing Sheets

SYSTEM AND METHOD FOR CLEANING A NOZZLEPLATE

CROSS-REFERENCE TO RELATED APPLICATIONS

This application is a 371 National Stage Application of PCT/EP2012/062228, filed Jun. 25, 2012. This application claims the benefit of U.S. Provisional Application No. 61/502,877, filed Jun. 30, 2011, which is incorporated by reference herein in its entirety. In addition, this application claims the benefit of European Application No. 11171932.4, filed Jun. 29, 2011, which is also incorporated by reference herein in its entirety.

BACKGROUND OF THE INVENTION

1. Field of the Invention

The present invention relates to inkjet printing systems. More particularly the present invention relates to a mechanism for cleaning a printhead.

2. Description of the Related Art

Inkjet printing uses a printhead that has a nozzle plate in which an array of nozzles is present. The nozzles eject small droplets of ink for forming an image on a printable substrate.

Inkjet printing systems are used in a wide array of applications such as home and office printers and photo printing but also in industrial printing, including poster printing, signage, packaging, transactional printing etc.

To improve the clarity and the contrast of a printed image, recent research has focused on improvements of the inks. To provide quicker printing with darker blacks and more vivid colors, pigment based inks have been developed. These pigment-based inks have a higher solid content than the earlier dye-based inks. Both types of ink dry quickly, which allows inkjet printing mechanisms to form high quality images.

A recognized problem in inkjet printers is that the nozzles through which the ink is ejected to the printable substrate can be blocked by clogging of ink inside the nozzles and on the printhead. This can be caused by evaporation of the solvent of the ink at the nozzle location, thereby leaving clusters of pigment particles that clog the nozzle. This renders certain nozzles inoperable and results in deteriorated print quality by the introduction of banding and streaking.

In some industrial applications the required printing speed is so high that it is impossible to rely on evaporation of a solvent or water for the drying of the inks. In that case a solution is offered by the use of UV-curable inks. These UV-curable inks allow for fast solidification under the exposure of high intensity UV-curing lamps. A problem that can occur with this system is that stray-light from the UV-curing source can reach the nozzle plate and can cause solidification of the UV-curable ink near the nozzles, thereby affecting the direction that droplets are jetted and sometimes clogging them.

Other causes of clogging may be dust from dried ink or media fibers (for example paper fibers), or solid particles within the ink itself.

The use of smaller nozzles, which allows for increasing the resolution and the image quality of the print, exacerbates the problem of clogging.

A number of prior art solutions exists for reducing the problem of clogging. These solutions can be used by themselves or in combination.

A first prior art method uses a capping unit. During non-operational periods the printhead can be sealed off from contaminants by a sealing enclosure. This also prevents the drying of the ink. The capping unit usually consists of a rubber seal placed around the nozzle array.

A second prior art method uses spitting. By periodically firing a large number of drops of ink through each nozzle into a waste ink receptacle, commonly called a spittoon, clogs are cleared from the nozzles. This can be concentrated to nozzles which have been identified as being clogged, but usually all the nozzles are actuated during the spitting operation.

A third prior art method uses vacuum assisted purging. During a special operation, in order to clear partially or fully blocked nozzles, a printing cycle is actuated while on the outside of the nozzles a vacuum is applied. This helps clearing and cleansing of the nozzles. The purging is normally performed when the printhead is in a capping unit, because this unit can provide a good seal around the nozzle array for building up the vacuum.

A fourth prior art method uses the application of cleaning fluids. By applying cleaning fluid ink to the nozzle plate, residue on the nozzle plate or within the nozzles is dissolved and the printhead can be cleaned. An example of such a method is found in the publication EP-1 018 430, by Eric Johnson e.a. and having a priority date of 2000 Jan. 6.

Yet another prior art method uses a wiper. Before and during printing the inkjet printhead is periodically wiped clean using an elastomeric wiper, removing ink residue, paper dust and other impurities.

Different combinations of multiple techniques have been known to clean the inkjet printheads.

For example, in the publication U.S. Pat. No. 6,241,337 by Ravi Sharma having a priority date of 1998 Dec. 23, wiping is performed in combination with vibrations and the application and removal of a cleaning fluid. A disadvantage of this method is that the combination of the wiping action with the vibrations has proven to be abrasive for the nozzle plate. This reduces the life of the printhead.

In the publication U.S. Pat. No. 5,557,306 by Tohru Fukushima and having a priority date of 1993 Dec. 15, ink is released from the nozzle plate, the plate is brushed and wiped afterwards. Due to the wiping action wear and tear of the nozzle plate is considerable.

The system described in the publication U.S. Pat. No. 6,164,754 by Daisaku Ide and having a priority date of 2000 Dec. 26 avoids the use of a flat wiper blade by using an elastic cleaning member that fits exactly within a longitudinal groove of the printhead and in which the nozzle section resides. This gives an unsatisfactory result in that the elastic cleaning member may damage the printhead while it is wiping the nozzles.

The technical features that are designed to clean and to protect a printhead are usually located in a service station within the plotter frame. Maintenance of the printhead takes place by moving the printhead to the maintenance station. An example of such a service station can be found in publication U.S. Pat. No. 6,193,353 by Juan Carles Vives and having a priority date of 1998 Mar. 4 where a combination is described of wiping, capping, spitting and purging functions.

A relevant prior art document with regard to the current application is found in U.S. Pat. No. 6,869,161 by Paul Wouters having a priority date of 2002 Jul. 8. This document teaches a method for cleaning the nozzle plate of an inkjet printhead by providing a cleaning fluid to the nozzle plate, by brushing the nozzle plate with a brush in the presence of the cleaning fluid, and subsequently removing the cleaning fluid with the debris by a vacuum.

The above prior art method solves many of the issues of the other prior art techniques in that is gentle on the nozzle plate and avoids wear and tear of the nozzle plate.

However, a problem with this prior art method is that the vacuum is not capable to remove all the cleaning fluid. As a result the excess cleaning fluid and debris can soil the cleaning station and the printhead.

An improved method is therefore required that has the advantages of the method described in the published patent U.S. Pat. No. 6,869,161, but that avoids that excess cleaning fluid is spilled.

SUMMARY OF THE INVENTION

The drawbacks of the prior art methods are solved by a cleaning system described herein.

According to a preferred embodiment of the cleaning system, a first slit is provided in a first horizontal surface of the cleaning system that is underneath and parallel to the nozzle plate of a printhead that needs maintenance. A cleaning fluid flows out of this first slit under a pressure that is higher than the atmospheric pressure, and follows a laminar path on the first surface of the maintenance module. On its way to the front of the cleaning module, the laminar flow of cleaning fluid is in contact with the nozzle plate and picks up loose debris. The laminar flow is collected in a collector tank. On its way in a second direction that is opposite to the first direction, the cleaning fluid passes through a brush. The brush is pretensioned by a pretensioning system such as for example a spring, and pushes with a carefully controlled pressure against the nozzle plate. The brush brushes the printhead as the maintenance module moves longitudinally underneath the printhead. The laminar flow of the cleaning fluid that flows through the brush collects debris and other unwanted substances that are collected by the brush. A first portion of the cleaning fluid that has passed through the brush is drained through a second slit in the first surface. For that purpose the second slit is put under a second pressure that is lower than the atmospheric pressure. The remaining portion of the cleaning fluid that has passed through the brush is drained by a third slit that is located in a second plane that is also parallel with the nozzle plate but that is slightly raised with regard to the first plane. The third slit is under a third pressure that is lower than the second pressure of the second slit. This is the result of the Bernoulli effect since the distance between the second plane and the nozzle plate is narrower than the distance between the first plane and the nozzle plate.

Other variations of the above preferred embodiments are disclosed herein.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Overview

Figure 2:
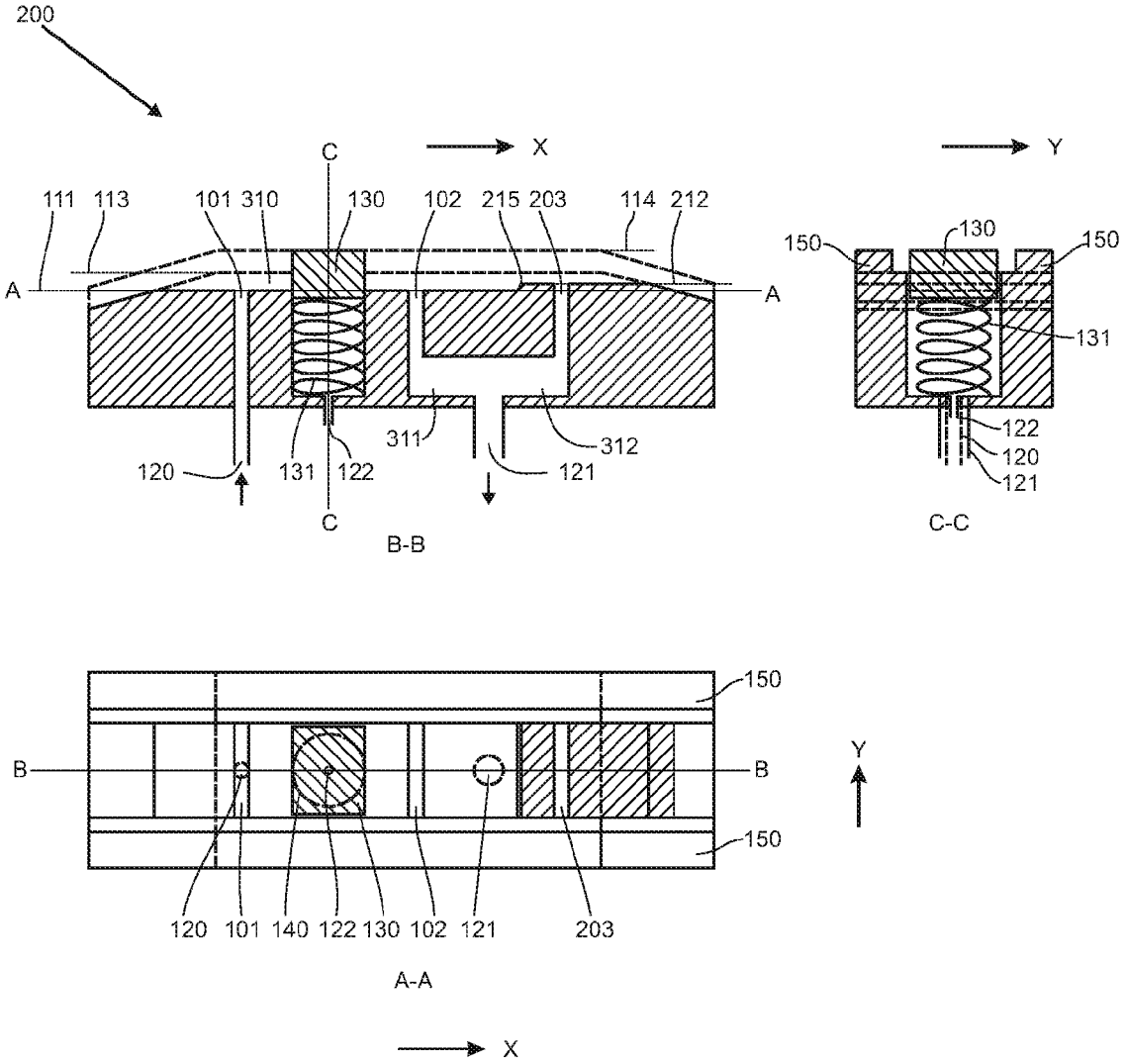
FIG. 2 shows three cross sections of an improved maintenance system according to a preferred embodiment of the current invention.

FIG. 2 shows an overview of a cleaning module according to the current invention.

A cleaning fluid is fed into the module through a cleaning fluid supply channel 120. The fluid is jetted upwardly under a first pressure P1 greater than the atmospheric pressure through a first slit 101 onto a first surface 111 having a level L1. This first surface 111 is underneath and parallel with the nozzle plate 302 that is to be cleaned.

The cleaning fluid flows over the first surface 111 in a laminar flow into two directions.

A first laminar flow 314 flows from the supply slit 101 over the first surface towards the front of the cleaning module. This laminar flow is in contact with the nozzle plate and collects loose debris that is sitting on the nozzle plate. At the front of the cleaning module it is collected into collector tank 315.

A second laminar flow flows from the supply slit 101 towards a second slit 102 in the first surface, where a first portion 311 is drained under the influence of a second pressure P2 that is lower than the atmospheric pressure. The remaining portion 312 of the fluid flows to a third slit 203 where it is drained under a third pressure P3 that is lower than the second pressure P2.

Between the first slit 101 and the second slit 102 resides a brush 130 that is pretensioned by a spring 131. The brush is in gentle contact with the nozzle plate 302 of a printhead 300 in FIG. 3. The printhead moves in a direction indicated by the arrow in FIG. 3 relative to the cleaning module. This brushing action removes debris and dust from the printhead and collects them in the brush. The laminar flow of the cleaning fluid passes through the brush 130 and takes the debris and particles with it.

Brush

The constitution of the brush 130 may vary, and any appropriate woven fabric e.g. velvet or non-woven e.g. felt can be used.

The chemical composition of the brush 130 can be adapted to the composition of the ink and/or the nozzle plate 302. Possible materials which can be used and have proven effectiveness are e.g. polytetrafluoroethylene (PTFE) and polypropylene.

Other materials are possible. The following list is not to be considered limitative: polytetrafluoroethylene, Polypropylene, Polyurethane, Polyester, Aramid, Cellulose, Viscose or Nylon.

Making the brush 130 from PTFE has the advantage that the brush fibers are chemically inert and that the brush 130 has certain self cleaning properties. Low hardness of the material avoids scratching of the nozzle plate 302.

The brush 130 may also help the cleaning process by creating a more uniform cleaning fluid flow over the printhead.

The constitution of the brush 130 is a trade-off between several desired parameters. E.g. in order to provide good brushing and exert a certain force of the printhead 300 the brush fibers need to have a certain rigidity and more fibers or brush hairs enable better cleaning. However since the laminar flow of cleaning fluid has to pass through the brush, a minimum porosity of the brush 130 is required.

The brush is pretensioned by a pretensioning system such as the spring 131 so that it remains in gentle contact with the nozzle plate 302 during a cleaning cycle. The pressure of the brush against the nozzle plate is preferably in the range from 0.1 N to 50.0 N, even more preferably in the range from 0.1 N to 5.0 N, and even more preferably in the range from 0.1 to 0.5 N.

Direction and Speed of Cleaning

According to a preferred embodiment, the brushing action is performed by moving the cleaning system and the printhead with regard to each other in the longitudinal direction of the printhead. However, depending on the size of the head or the internal printer arrangement, transversal cleaning or cleaning in any direction across the nozzle array is also possible.

Cleaning speeds may vary between 0.001 and 0.1 m/s but are preferably between 0.005 and 0.02 m/s.

The cleaning module itself may be stationary, whereby brushing action is performed by traveling the printhead 300 over the cleaning module, or alternatively the cleaning module may be moveable so that moving the module over stationary printhead 300 enables the brushing.

It is possible to provide multiple brushing actions by translating the printhead and the cleaning module multiple times back and forth with regard to each other. However it is mandatory that during the last brushing action, the relative direction of the cleaning module and the printhead is such that printhead leaves the contact with the cleaning module on the side where the third slit 203 resides, since only in that direction any remaining cleaning fluid on the nozzle plate is drained through slit 203. This relative direction is indicated by the arrows in FIG. 3.

To enhance the cleaning capacity it is possible to provide an extra movement of the brush 130. For example, during the translation movement the brush 130 with regard to the printhead 300 may be rotated, rotationally oscillated or vibrated for enhancing the cleaning and dissolving capabilities of the brush.

Also the introduction of sonic or ultrasonic vibrations to the brush enhances the capacity for loosening debris and dried ink. Such movements can easily be actuated by for example a piezo-electric transducer.

The brush 130 can also be additionally cleaned by using a stationary scraper wiping collected debris from the hairs of the brush.

Brush Conditioning

It has been found that when the brush 130 has dried out, for example as a result of a long time of inactivity, a certain time is needed to fully wet the brush again. During this time cleaning is inefficient at first. This can be avoided by storing the inactive cleaning module or the brush 130 in a capping module inside the printer. The saturated atmosphere of the cleaning fluid avoids drying out of the brush 130 by keeping a cleaning fluid. Inside the capping, the cleaning module can be activated to rinse the brush 130 so that it becomes free of debris and dried particles.

When using a cleaning fluid, cleaning and dissolving power is greatly determined by the properties of the cleaning fluid.

One of the most important properties is the surface tension. When the surface tension is too low, a thin film will be left on the nozzle plate 302 forming small drops which will after drying result in small dry particles. A high surface tension enables easy removal of the cleaning fluid but makes it difficult to bring cleaning fluid and contaminant (dried ink, debris) into contact.

Another aspect is the chemical compatibility of the cleaning fluid with the contaminants. Pure ink is normally fully chemically compatible with dried ink and has a low surface tension and therefore cannot be easily removed by the low pressures P2 and P3 in the slits 102 and 203.

Pure water can be easily removed but has reduced dissolving power. Hence a trade-off between wetting capability and dissolving power has to be found. This can be done by mixing e.g. ink with the cleaning fluid.

Further aspects influencing the cleaning capacity of the cleaning fluid are for example the composition of the anti-wetting coating of the nozzle plate 302, possible additives in the cleaning fluid, temperature of the cleaning fluid, etc.

Yet another aspect is that the flow of cleaning solution has to be balanced with the strength of the pressure P2 at the slits 102 and the pressure P3 at the slit 203. When these pressures are not low enough, cleaning fluid will be left on the printhead, while when these pressures are too low, the laminar flow through the brush will be too thin to effectively loosen and dissolve the dried ink and debris.

The cleaning fluid that is drained can be collected as a waste product for later removal. However in a more preferable embodiment the cleaning fluid is recycled and reused after e.g. filtering or other purification methods. This reduces waste generation by the printer. Such purification methods as filtering, centrifuge, distillation etc are known in the art and need no further detailing.

Jetting of Cleaning Fluid

In order to generate the laminar flow or movement of cleaning fluid over the nozzle plate 302, the cleaning fluid is preferably jetted onto the nozzle plate 302 through the slit 101 under an angle with the normal of the nozzle plate 302 between 0 and 80 degrees.

This provides a good in depth cleaning of the nozzles and enables the generation of the cleaning fluid flow over the nozzle plate 302.

Jetting the cleaning fluid with a sufficient flow helps to loosen debris that is attached to the nozzle plate and that is carried away by the laminar flow 314 towards the front of the cleaning station where it is collected in a collector tank 315.

Direction of the jet can be adapted to the desired cleaning speed or jetted flow. The cleaning fluid flow 311 between the first slit 101 and the second slit 102 is preferably between 5 to 300 ml per minute.

Instead of using a standard laminar flow of the applied cleaning fluid more efficient regimes are possible:

- Air bubbles are introduced in the flow of the cleaning fluid, this gives a more aggressive and efficient cleaning;
- a pulsing cleaning fluid flow also gives more efficient cleaning.

Pressure P1, P2 and P3

The pressure P1 at the first slit 101 serves to supply a flow of cleaning liquid. It is mainly dictated by the desired flow and serves to control this flow.

The pressure that is applied at the drain 121 is lower than the atmospheric pressure and serves two purposes:

- it serves to remove the cleaning solution and debris in it.
- it drives and directs the laminar flow of the cleaning fluid from the supply slit 101 to the two fluid drain slits 102 and 203.

According to a preferred embodiment of the invention, the direction for moving the printhead relative to the cleaning module (indicated by the arrows in FIG. 3) is opposite to the direction of the laminar flow 310, 311 and 312 of the cleaning fluid from the supply slit 101 to the first and second drain slits 102, 203.

In that case it is mandatory that that the pressure values P1, P2 and P3 are selected such that velocity of the laminar flows 311 and 312 of the cleaning fluid are at least greater than zero, to avoid a reverse flow of the cleaning fluid and a build up of debris at the brush 130 or at the slit 101.

Optionally the direction of the laminar flow and the printhead relative to the cleaning module is the same.

In that case it is mandatory that that the pressure values P1, P2 and P3 are selected such that velocity of the laminar flow of the cleaning fluid is higher than the velocity by which the printhead moves relative to the cleaning module, so that the cleaning fluid debris is effectively drained through the slits 102 and 203.

The second pressure P2 at the nozzle plate 302 near the first fluid drain slit 102 is preferably between 0.05 and 0.5 bar lower than atmospheric pressure, even more preferably between 0.05 and 0.25 bar.

The third pressure P3 at the nozzle plate 302 near the second fluid drain slit 203 must always be lower than the first pressure P1 and is preferably between 0.1 and 0.5 bar lower than atmospheric pressure.

Figure 1:
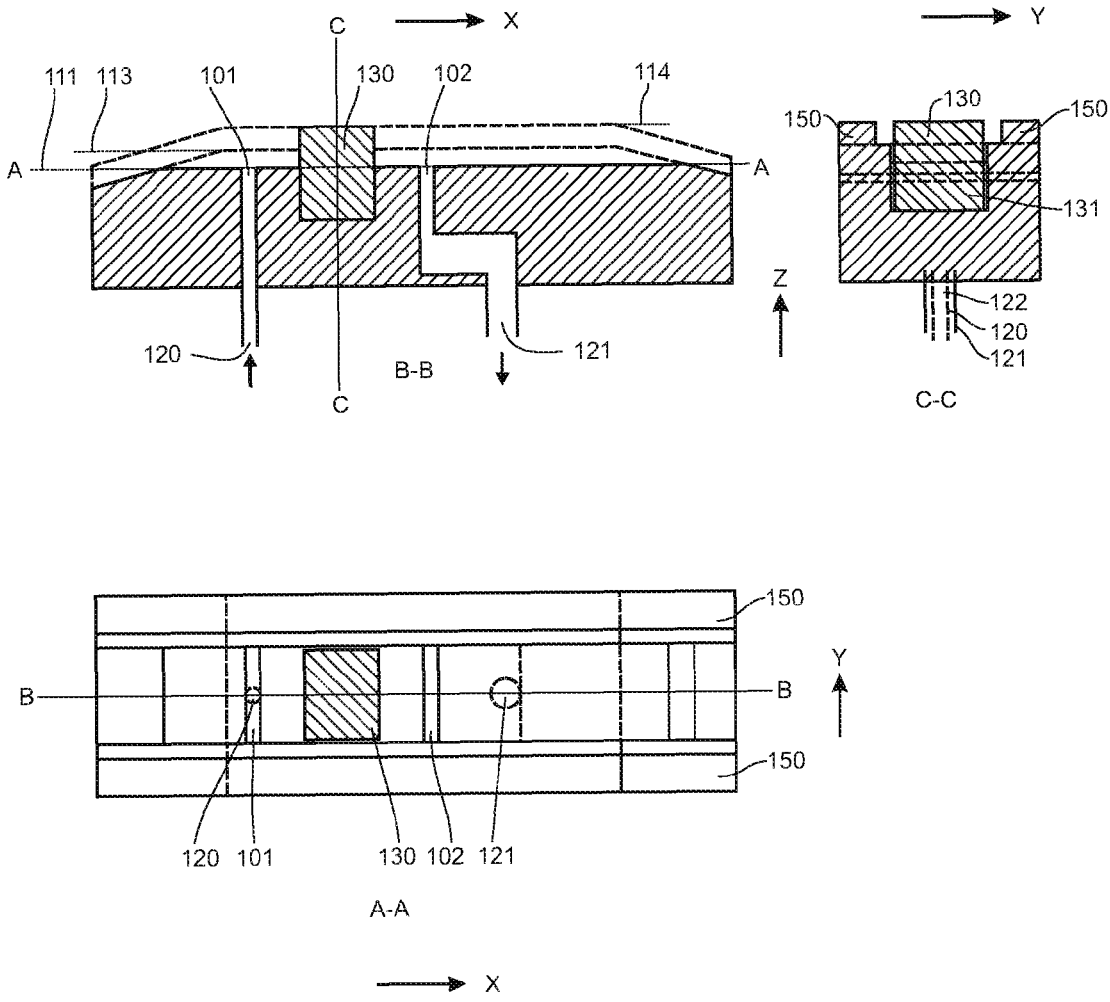
FIG. 1 (PRIOR ART)
FIG. 1 shows three cross sections of a prior art maintenance system for cleaning the nozzles in a nozzle plate of a printhead.
Figure 3:
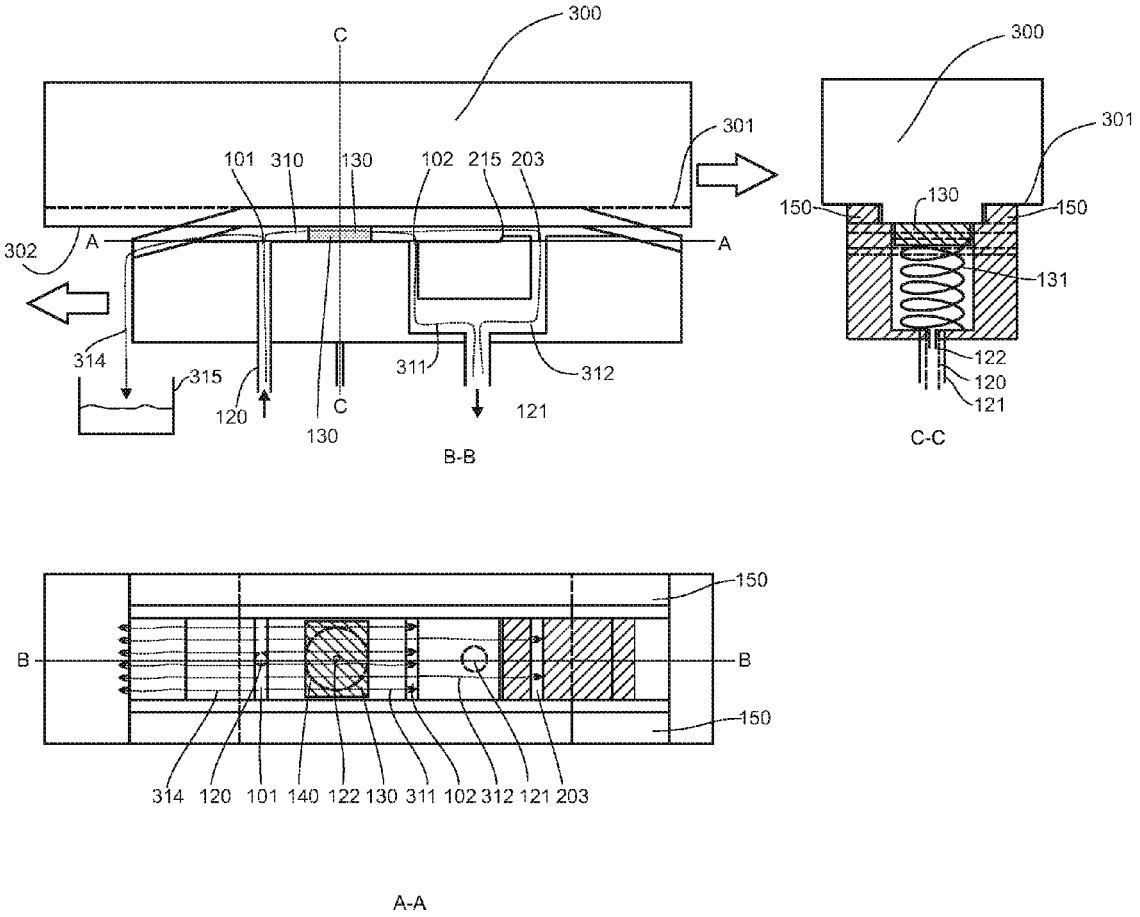
FIG. 3 shows two cross sections of the improved maintenance system in cooperation with a printhead.

In FIG. 1, FIG. 2 and FIG. 3, the small drain 122 is also under pressure lower than the atmospheric pressure. When the pretensioned brush is pushed in, the excess ink that resides in the space where the spring 131 is housed can be extracted through this drain 121.

The upper limit of the above pressure ranges is the minimum necessary for effectively extracting the cleaning fluid, whereas the lower limit is dictated by the constraint that pressure values that are too low would extract too much ink from the printhead through the nozzles in the nozzle plate 302.

The distance between the nozzle plate 302 and the first surface 111 and the second surface 212 is critical in that it directly affects the pressure values P2 and P3. These pressures are build up as the result of the Bernoulli effect on the first stream 311 and the second stream 312 of the cleaning fluid that results from applying a low pressure at the cleaning fluid drain 121.

Since a first distance D1=|L3−L1| between the nozzle plate 302 at the level L3 and the first surface 111 at a level L1 that is parallel with the nozzle plate 302 is larger than a second distance D2=|L3−L2| between the nozzle plate 302 and a second surface 212 at a level L2 that is parallel with the nozzle plate 302, the Bernoulli effect will cause a lower pressure near the slit 203 than near the slit 102. In other words:

$$D2<D1 \text{ results in } P3<P2$$

When the distances D1 or D2 are too short, the printhead may be accidentally damaged due to contact between the nozzle plate 302 and the surfaces 111 or 212. Another problem that could arise is that the cleaning fluid flow becomes obstructed so that cleaning and removal of debris becomes problematic.

On the other hand, when the distances D1 or D2 are too large, it will be difficult to maintain pressures P2 and P3 that are sufficiently low for maintaining the laminar flows 311 and 312.

In a practical situation the value of |L3−L1| is in the range of 0.2 mm to 5.0 mm whereas the distance |L3−L2| is in the range of 0.1 to 4.9 mm.

The distance between the nozzle plate 302 and the surface 111 can be maintained by providing protrusions 150 on the cleaning system. These protrusions 150 are preferably located outside of the cleaning area and stay in contact with the printhead outside of the nozzle plate 302. As cleaning is performed, the protrusions 150 slide over the printhead and thus keep a constant distance to the nozzle plate 302 located in between the two protrusions.

The ideal combination of parameters for all cleaning components has to be determined on a case by case basis.

For example, a change in ink composition, cleaning speed, brush properties etc. all can influence the operation and the effectiveness of the cleaning module.

In a specific setting it may be necessary to try out different combinations for determining the optimal set of parameters for obtaining an effective cleaning of the nozzle plate and at the same time to avoid that excess cleaning fluid is spilled.

Working points are to be determined and can vary depending upon—without limitation—the following parameters:

- geometry of the cleaning module: the width and the length of the first surface 111 and the second surface 212;
- the width and the length of the nozzle plate 302;
- the lateral speed at which the printhead and the cleaning module translate with regard to each other;
- the type of ink that is used;
- the position, the width and the length of the first slit 101, the second slit 102 and the third slit 103;
- the distance between the fluid application and vacuum slit and their distance to the brush and the edges of the cleaning module;
- the distance D1=|L3−L1| between the nozzle plate 302 and the first surface 111 and the distance D2=|L3−L2| between the nozzle plate 302 and the second surface 212;
- the type and the size of the brush 130;
- the pressure P1 that is applied to the supply 120;
- the pressure that is applied to the cleaning fluid at drain 121.

EXAMPLE

- the width of the first surface 111: 4.2 mm;
- the length of the second surface 212: 1.5 mm;
- the width of the nozzle plate 302: 6 mm;
- the lateral speed at which the printhead and the cleaning module translate with regard to each other: 0.01 m/s;
- the type of ink that is used: UV-curable ink;
- width of brush: 5.5 mm;
- length of brush: 6.0 mm;
- width of first slit: 0.5 mm;
- length of first slit: 6.5 mm;
- width of second slit: 0.5 mm;
- length of second slit: 6.5 mm;
- width of third slit: 0.5 mm;
- length of the third slit: 6.5 mm;
- the distance between the fluid supply slit 101 and the first drain slit 102: 9.0 mm;
- the distance between the fluid supply slit 101 and the heart of the brush: XXX;
- the distance |L3−L1| between the nozzle plate 302 and the first surface 111: 0.4 mm;
- the distance |L3−L2| between the nozzle plate 302 and the second surface 212: 0.2 mm;
- the type and the size of the brush 130: PTFE, L*W*H: 6.0 mm*5.5 mm*4.5 mm;
- the pressure that is applied to the supply 120: 1 bar+0.5 bar;
- the pressure applied to the cleaning fluid drain 121: 1 bar−0.18 bar.

Having described in detail preferred embodiments of the current invention, it will now be apparent to those skilled in the art that numerous modifications can be made therein without departing from the scope of the invention as defined in the claims.

LIST OF NUMBERS IN DRAWINGS

101: cleaning fluid supply slit
102: first cleaning fluid drain slit

203 second cleaning fluid drain slit
111: horizontal level L1 of a first surface that is parallel with the nozzle plate
212: horizontal level L2 of a second surface that is parallel with the nozzle plate
113: horizontal level L3 of the nozzle plate of the printhead
114: horizontal level L4 of the rails of the maintenance system
215: nip
120: cleaning fluid supply
121: first cleaning fluid drain
122: second cleaning fluid drain
130: brush
131: spring
150: protrusions
300: printhead
301: resting surface
302: nozzle plate
310: first laminar flow
311: second laminar flow
312: third laminar flow
313: fourth laminar flow
314: collector tank
X: X-dimension
Y: Y-dimension
Z: Z-dimension

The invention claimed is:

1. A system for cleaning a nozzleplate of a printhead in an inkjet printing system, the system comprising:

a first surface underneath and parallel to the nozzleplate at a distance D1 from the nozzleplate;

a first slit in the first surface to provide, under a first pressure P1 larger than atmospheric pressure, a first laminar flow of cleaning fluid between the first surface and the nozzleplate of the printhead;

a brush on the first surface to brush the nozzleplate and through which the first laminar flow of cleaning fluid passes to remove debris from the nozzleplate;

a second slit in the first surface to drain a first portion of the first laminar flow of the cleaning fluid by a second pressure P2 that is lower than the atmospheric pressure;

a mechanism to move the system parallel to the nozzleplate of the printhead to provide a brushing action;

a pretensioning system to push the brush against the nozzleplate of the printhead;

a second surface underneath and parallel to the nozzleplate at a distance D2 from the nozzleplate, wherein the distance D2 is smaller than the distance D1; and a third slit in the second surface that is raised with regard to the first surface to drain a second portion of the first laminar flow of the cleaning fluid by a third pressure P3 which is lower than the second pressure P2.

2. The system according to claim 1, wherein the first slit additionally provides a second laminar flow between the first surface and the nozzleplate of the printhead and that flows in a direction opposite to the first laminar flow to carry away debris from the nozzleplate to a front of the system where the debris is collected in a collector tank.

3. The system according to claim 1, wherein the brush is composed of polytetrafluoroethylene, polypropylene, polyurethane, polyester, aramid, cellulose, Viscose, or Nylon.

4. The system according to claim 1, wherein a speed of moving the system is between 0.001 and 0.1 meter/sec.

5. The system according to claim 1, wherein the distance D1 is in a range from 0.2 mm to 6.0 mm, and the distance D2 is in a range from 0.1 mm to 5.9 mm.

6. The system according to claim 1, wherein the pressure P1 is in a range from 0.1 bar to 6.0 bar above the atmospheric pressure.

7. The system according to claim 1, wherein the pressure P2 is in a range from 0.05 bar to 0.25 bar below the atmospheric pressure, and the pressure P3 is in a range from 0.05 bar to 0.5 bar below the atmospheric pressure.

8. The system according to claim 1, wherein the pretensioning system pushes the brush against the nozzle plate with a force in the range of 0.1 N to 50.0 N.

9. The system according to claim 8, wherein the pretensioning system pushes the brush against the nozzleplate with a force in the range of 0.1 N to 5.0 N.

10. An inkjet printer comprising a system for cleaning a nozzleplate of a printhead according to claim 1.

11. A method for cleaning a nozzleplate of a printhead in an inkjet printing system, the method comprising the steps of:

providing, under a first pressure P1 that is higher than atmospheric pressure through a first slit in a first surface that is underneath and parallel to the nozzleplate of the printhead at a first distance D1, a first laminar flow of cleaning fluid between the first surface and the nozzleplate;

passing the first laminar flow through a brush on the first surface to collect debris;

draining, using a second pressure P2 that is lower than the atmospheric pressure, a first portion of the first laminar flow through a second slit in the first surface;

moving the printhead relative to the brush to obtain a brushing action;

pretensioning the brush against the nozzleplate using a pretensioning system; and draining, using a third pressure P3 that is lower than the second pressure P2, a second portion of the first laminar flow through a third slit in a second surface that is underneath and parallel to the nozzleplate of the printhead at a second distance D2, wherein D2<D1.

12. The method according to claim 11, further comprising the steps of:

providing, under the first pressure P1, a second laminar flow between the first surface and the nozzleplate in a direction that is opposite to the first laminar flow to carry away loose debris at the nozzleplate; and collecting the second laminar flow in a collector tank.

* * * * *